US007289065B2

(12) United States Patent
Prieto-Burgos et al.

(10) Patent No.: US 7,289,065 B2
(45) Date of Patent: Oct. 30, 2007

(54) ANTENNA

(75) Inventors: Carlos Prieto-Burgos, Sant Boi (ES); Rainer Wansch, Hagenau (DE)

(73) Assignee: Fraunhofer-Gesellschaft zur Foerderung der angewandten Forschung e.V. (DE)

( * ) Notice: Subject to any disclaimer, the term of this patent is extended or adjusted under 35 U.S.C. 154(b) by 119 days.

(21) Appl. No.: 11/225,961

(22) Filed: Sep. 14, 2005

(65) Prior Publication Data

US 2006/0109177 A1 May 25, 2006

(30) Foreign Application Priority Data

Sep. 21, 2004 (DE) ..... 10 2004 045 707

(51) Int. Cl.
*H01Q 1/38* (2006.01)
*H01Q 9/28* (2006.01)

(52) U.S. Cl. ..... 343/700 MS; 343/795

(58) Field of Classification Search ..... 343/700 MS, 343/795, 793, 846
See application file for complete search history.

(56) References Cited

U.S. PATENT DOCUMENTS

| | | | | |
|---|---|---|---|---|
| 4,922,259 | A | 5/1990 | Hall et al. | |
| 5,926,150 | A | 7/1999 | McLean | |
| 5,955,995 | A | 9/1999 | Silverstein | |
| 6,307,510 | B1 | 10/2001 | Taylor et al. | |
| 6,351,239 | B1 | 2/2002 | Mizuno et al. | |
| 6,906,675 | B2 | 6/2005 | Satoh | |
| 2003/0146876 | A1* | 8/2003 | Greer et al. | 343/702 |
| 2004/0017325 | A1 | 1/2004 | Satoh et al. | |
| 2004/0155831 | A1 | 8/2004 | Goebel et al. | |
| 2005/0110687 | A1* | 5/2005 | Starkie et al. | 343/700 MS |

FOREIGN PATENT DOCUMENTS

| | | |
|---|---|---|
| DE | 100 25 262 A1 | 8/2001 |
| EP | 1 231 571 A2 | 8/2002 |
| JP | 2000-314337 | 10/2001 |
| JP | 2001189615 | 10/2001 |

OTHER PUBLICATIONS

International Search Report (ISA); PCT/EP2005/009617; Sep. 7, 2005.

Boyle K R: "Differentially slotted and differentially fileed PIFAs" Electronics Letters, IEE Stevenage, GB, Bd. 39, Nr. 1, Jan. 9, 2003; pp. 9-10; ISSN: 0013-5194.

* cited by examiner

*Primary Examiner*—Hoang V. Nguyen
(74) *Attorney, Agent, or Firm*—Beyer Weaver LLP

(57) ABSTRACT

An antenna comprises a first planar antenna and a second planar antenna. A coupler for coupling serves for coupling the first planar antenna to a first component of a differential signal and for coupling the second planar antenna to a second component of the differential signal.

9 Claims, 5 Drawing Sheets

ANTENNA

CROSS-REFERENCE TO RELATED APPLICATION

This application claims priority from German Patent Application No. 10 2004 045 707.7, which was filed on Sep. 21, 2004, and is incorporated herein by reference in its entirety.

BACKGROUND OF THE INVENTION

1. Field of the Invention

The present invention relates to antennas and, in particular, to antennas formed of a plurality of planar antennas.

2. Description of Related Art

Antennas are used for wireless coupling of data transmission devices. Depending on the field of application, antennas having special characteristics are selected. Thus, compromises must be made, taking integrability, gain, noise or the bandwidth of an antenna into account. One of the decisive selection factors is the feed method of the antenna used. We differentiate between differential and single-ended feed.

When a differential signal routing is used in an antenna amplifier for a higher gain, lower noise or more simple design, a differentially fed antenna, such as, for example, a dipole antenna, should be selected ideally. Instead, a symmetry transformer, which is also called balun, transforming from a differential signal routing to a single-ended signal routing may be employed. In practice, the decision of the feed method determines the type of the antennas used or alternatively the usage of a symmetry transformer.

The dipole antenna or similar differentially fed antennas have the disadvantage that they must not have a ground area or metal area next to them and often are not integrable. The usage of a planar antenna, such as, for example, a patch antenna, allows improved integrability, but requires a symmetry transformer which may consume a considerable amount of space.

SUMMARY OF THE INVENTION

It is an object of the present invention to provide an integrable antenna.

In accordance with a first aspect, the present invention provides an antenna having: a first planar antenna; a second planar antenna; and means for coupling the first planar antenna to a first component of a differential signal and for coupling the second planar antenna to a second component of the differential signal.

The present invention is based on the finding that differentially fed planar antennas function like a dipole antenna, the arms of which are planar antennas. In particular, the planar antennas may be employed in connection with a differential feed system without a single-ended-to-differential transformation. The inventive approach relating to a differentially fed dipole antenna, the arms of which are planar antennas, overcomes the difficulties occurring when using well-known differentially fed antennas or when using well-know planar antennas, and offers other essential advantages. Particularly, the inventive approach allows using a differential feed in connection with planar antennas without an additional balun.

In contrast to conventional planar antennas, two planar antennas are fed differentially without an additional balun in the antenna according to the inventive approach. The result is an antenna which may be integrated fully on multi-layer substrates, the antenna including all the advantages of a differential feed and a planar antenna.

An antenna according to the inventive approach may be used in both a sender and a receiver, where differential feed and full integrability are required. Consequently, two opposing concepts, namely that of differential feed and that of planar antennas, are used together without requiring an additional element, such as, for example, a balun.

The usage of differential feed may be required for certain designs, such as, for example, in relation to noise or gain. The usage of two planar antennas according to the inventive approach additionally allows easier integrability of the differentially fed antenna.

Another advantage is the fact that the basic design of the planar antennas used for the inventive approach does not differ from the design of a single-ended-fed planar antenna. The adjustment to a desired frequency and radiation characteristic, however, is developed for the special configuration presented.

Both the electrical features and the radiation characteristic are improved considerably when using an antenna according to the inventive approach, resulting in an increase in performance. In particular, the inventive approach allows setting up the antenna on both sides of an electronics module such that emission takes place on both sides, and thus the omnidirectional characteristic of the antenna is improved.

The inventive approach is suitable for applications in wireless data transmission, for audio or video transmission and, in particular, in localization, i.e. wherever emission in, if possible, all directions is desired. In the form presented, the inventive antennas may be integrated in a planar way. This is suitable due to the small size, in particular in transmission frequencies in the centimeter and millimeter wave ranges. Very compact units can be manufactured in this way.

Due to its differential connections, the inventive antenna is expected to be employed in senders and receivers which utilize a differential feed due to higher performance, smaller noise and easier design. Furthermore, the inventive approach is ideal for senders or receivers where miniaturized antennas which, in relation to their size, have relatively broad bands, are to be integrated.

Due to the flexibility in set-up and integrability on planar circuits, the dipole antenna presented having planar arms is suitable for generating a desired omnidirectional diagram.

BRIEF DESCRIPTION OF THE DRAWINGS

Preferred embodiments of the present invention will be detailed subsequently referring to the appended drawings, in which.

DESCRIPTION OF PREFERRED EMBODIMENTS

Figure 1:
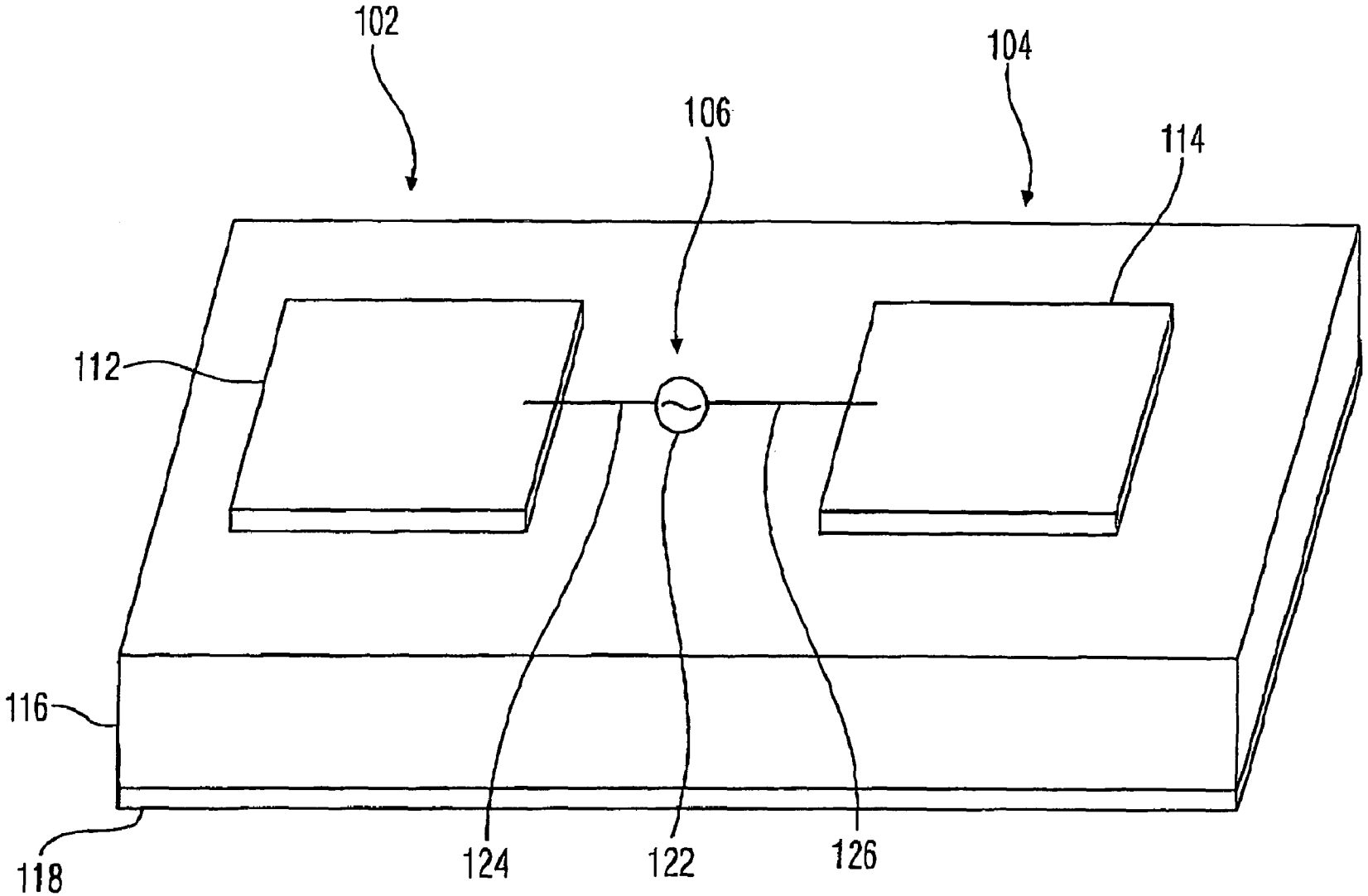
FIG. 1 is a schematic illustration of an antenna according to an embodiment of the present invention.

In the following description of preferred embodiments of the present invention, the same or similar reference numerals will be used for elements illustrated in different drawings and having similar effects, a repeated description of these elements being omitted.

FIG. 1 shows an antenna according to an embodiment of the present invention. The antenna has a first planar antenna 102 and a second planar antenna 104 which are connected via means 106 for coupling in or out a differential signal. The first planar antenna 102 comprises a first planar radiation element 112. The second planar antenna 104 comprises a second planar radiation element 114. The radiation elements 112, 114 are arranged on a first surface of a substrate 116 in a manner spaced apart from each other. An electrically conductive layer 118 is arranged on a second surface of the substrate 116. The second surface of the substrate 116 is arranged opposite the first surface of the substrate 116.

In this embodiment, the conductive layer 118 is a metallization layer forming a ground area of the planar antennas 102, 104. The substrate 116, such as, for example, a ceramic substrate, is formed as a dielectric. The first planar antenna 102 includes a layered set-up of the first planar radiation element 112, the substrate 116 and the electrically conductive layer 118. Correspondingly, the second planar antenna 104 includes the second planar radiation element 114, the substrate 116 and the electrically conductive layer 118.

The means for coupling 106 is schematically illustrated in FIG. 1. It shows a differential signal connection 122 or generator for providing a differential signal connected to the first planar antenna 102 via a first region 124 for providing a first component of the differential signal and connected to the second planar antenna 104 via a second region 126 for providing a second component of the differential signal. The first component of the differential signal is a signal inverted relative to the second component of the differential signal.

If the antenna shown in FIG. 1 is employed as a receiving antenna, the signal connection 122 is connected to evaluating means (not shown in the figures) for evaluating the first component received and the second component received of the differential signal.

It can be seen from FIG. 1 that the inventive antenna is a differentially fed planar antenna in a dipole configuration without employing a balun. The antenna shown consists of two planar antennas 102, 104 having the function of the dipole arms, for each planar antenna 102, 104 is fed from a different polarity (+/−). Relative to a dipole antenna, the first planar antenna 102 is a first dipole half and the second planar antenna 104 is a second dipole half.

The schematic illustration of the means for coupling 106 represents a differential feed or carry-off of a differential signal. The inventive antenna operates with all known feed methods of an antenna element. Examples of this are radiation coupling, feed via a microstrip line or a feed pin.

In this embodiment, the planar radiation elements 112, 114 are shown as planar rectangular layers formed of an electrically conductive material. The planar radiation elements 112, 114 may be, in contrast to the geometry shown, set up according to any other kinds of planar antenna geometry. A quadrangular, triangular or ring-shaped design are examples of this. Furthermore, the planar antennas may be formed as PIFAs (PIFA=planar inverted F antenna) or as stacked antennas.

According to another embodiment, the two dipole halves may each comprise a plurality of planar antennas.

Figure 2:
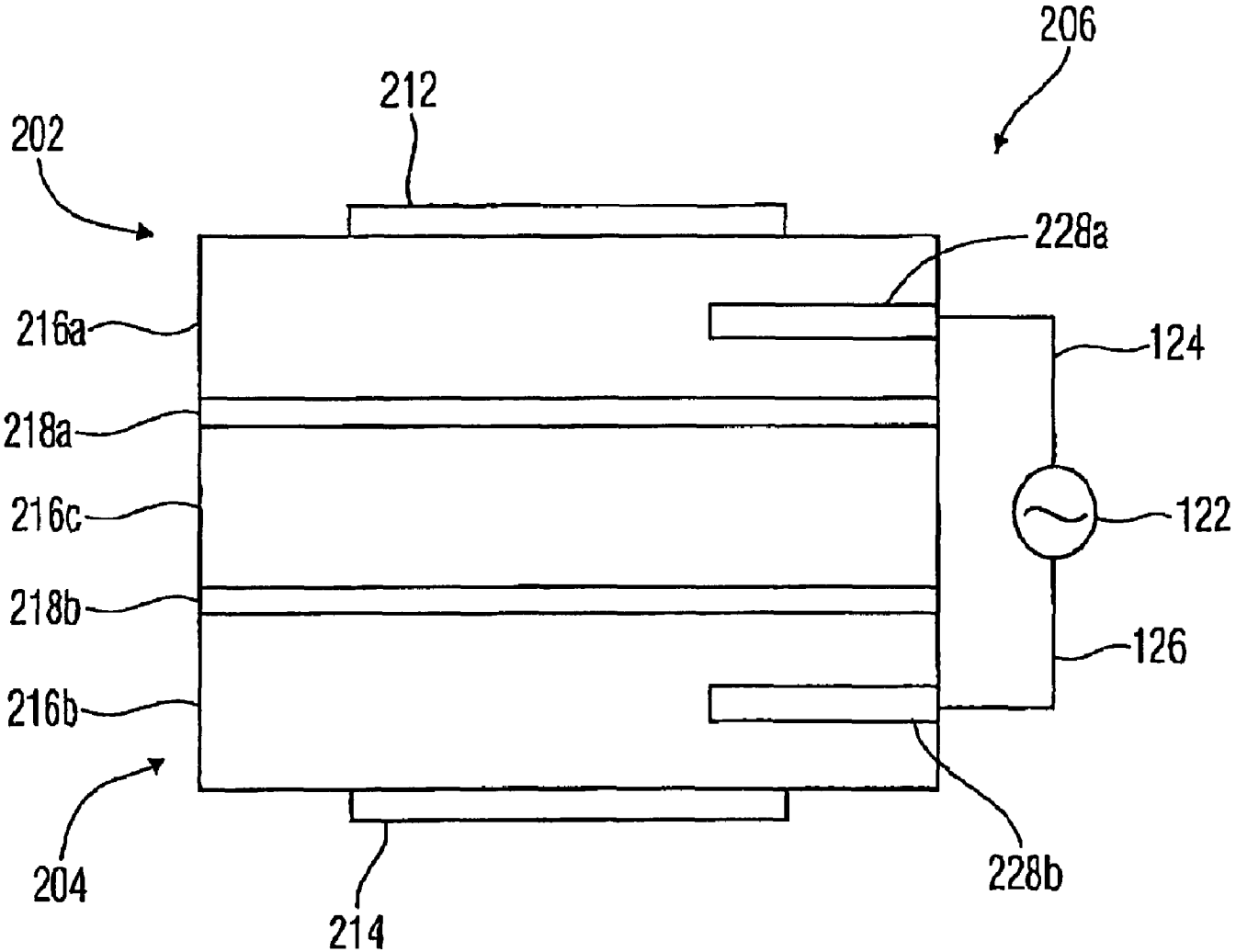
FIG. 2 is a schematic cross-sectional illustration of an antenna according to another embodiment of the present invention.

FIG. 2 shows a cross-sectional illustration of an antenna according to another embodiment of the present invention. The antenna comprises a first planar antenna 202, a second planar antenna 204 and means for coupling the planar antenna 202, 204 to a differential signal. The first planar antenna 202 comprises a first planar radiation element 212 and the second planar antenna 204 comprises a second planar radiation element 214. The antenna comprises a substrate stack including a first substrate layer 216*a*, a second substrate layer 216*b* and a third substrate layer 216*c*. An electrically conductive layer 218*a* in the form of a metallization is arranged between the first substrate layer 216*a* and the third substrate layer 216*c*. A second electrically conductive layer 218*b*, also in the form of a metallization, is arranged between the second substrate layer 216*b* and the third layer 216*c*. The first planar radiation element 212 of the first planar antenna 202 is arranged on a second surface of the first substrate layer 216*a* opposite the metallization 218*a*. The first planar antenna 202 is formed of the first planar radiation element 212, the first substrate layer 216*a* and the metallization 218*a*. The second planar radiation element 214 of the second planar antenna 204 is arranged on a surface of the second substrate layer 216*b* arranged opposite the second metallization 218*b*. The second planar antenna 202 is formed of the second planar radiation element 214, the second substrate layer 216*b* and the metallization 218*b*. The substrate layers 216*a*, 216*b*, 216*c* are formed as a dielectric.

According to the embodiment shown in FIG. 2, coupling in and out of the differential signal takes place via radiation coupling. The means 206 for coupling is schematically illustrated in FIG. 2 and comprises a differential signal connection 122, a first region 124 for providing the first component of the differential signal and a second region 126 for providing a second component of the differential signal. A first radiation coupling element 228*a* serves for connecting the first radiation element 212 to the first region 124 for providing the first component of the differential signal. Correspondingly, a second radiation coupling element 228*b* serves for connecting the second region 126 for providing the second component of the differential signal to the second radiation element 214. The radiation coupling elements 228*a*, 228*b* in this embodiment are formed as microstrip lines arranged in the first substrate layer 216*a* and the second substrate layer 216*b*, respectively, and projecting into an overlapping region of the radiation elements 212, 214 with the metallization layer 218*a*, 218*b*. A coupling between the radiation elements 212, 214 and the radiation coupling elements 228*a*, 228*b* may, for example, take place via capacitive or inductive coupling.

According to this embodiment, the radiation elements 212, 214 are arranged symmetrically on the substrate stack 216*a*, 216*b*, 216*c*. Preferably, the first planar antenna 202 is formed identically to the second planar antenna 204. In order to obtain special antenna characteristics, this symmetrical arrangement may be deviated from.

Figure 3:
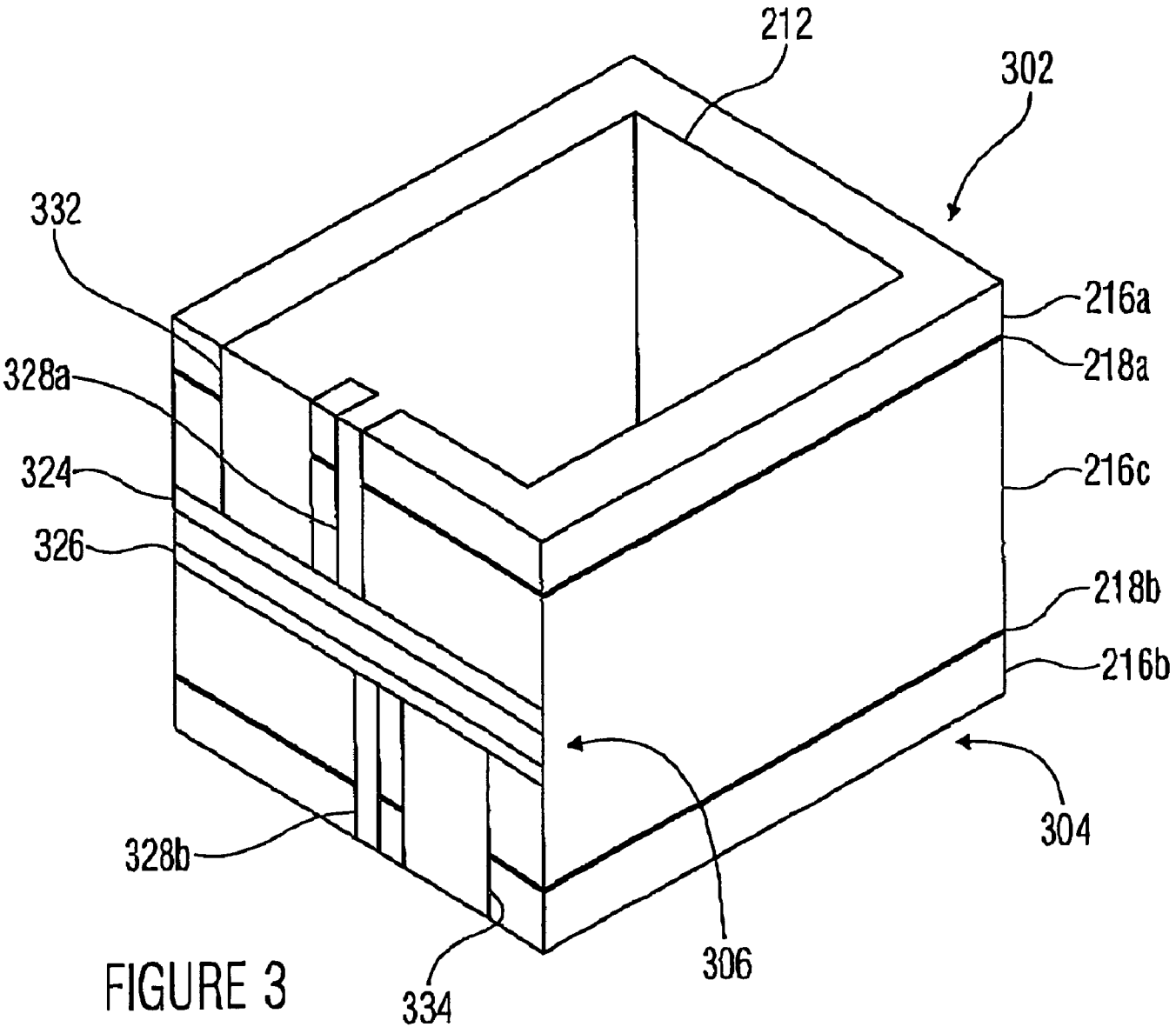
FIG. 3 is a side view of an antenna according to another embodiment of the present invention.

FIG. 3 shows a three-dimensional illustration of another embodiment of an antenna according to the present invention. According to this embodiment, a first planar antenna 302 and a second planar antenna 304 are formed as PIFA antennas, which are connected via means 306 for coupling in or out a differential signal.

The antenna shown in FIG. 3 comprises a layered set-up corresponding to the embodiment shown in FIG. 2. The first planar radiation element 212 of the first planar antenna 302 is arranged on a first surface of a first substrate layer 216*a*. A second planar radiation element of the second planar antenna 304 cannot be seen in FIG. 3 since it is arranged at the bottom of the second substrate layer 216*b*. A third substrate layer 216*c* connected to the first substrate layer 216*a* via the first metallization layer 218*a* and to the second substrate layer 216*b* via the second metallization layer 218*b* is arranged between the first substrate layer 216*a* and the second substrate layer 216*b*.

A differential signal connection including a first signal line 324 for routing the first component of the differential signal and a second line 326 for routing the second component of the differential signal is arranged in the third substrate layer 216*c*. The first line 324 is connected to the first radiation element 212 of the first planar antenna 302 via a first feed line 328*a*. The second line 326 for routing the second component of the differential signal is connected to the second radiation element (not shown in FIG. 3) of the second planar antenna 304 via a second feed line 328*b*.

A conductive layer arranged at one side of the substrate stack represents a first short-circuit plate 332 of the first PIFA antenna 302 and a second electrically conductive layer arranged at one side of the substrate stack represents a second short-circuit plate 334 of the second PIFA antenna 304.

Figure 4:
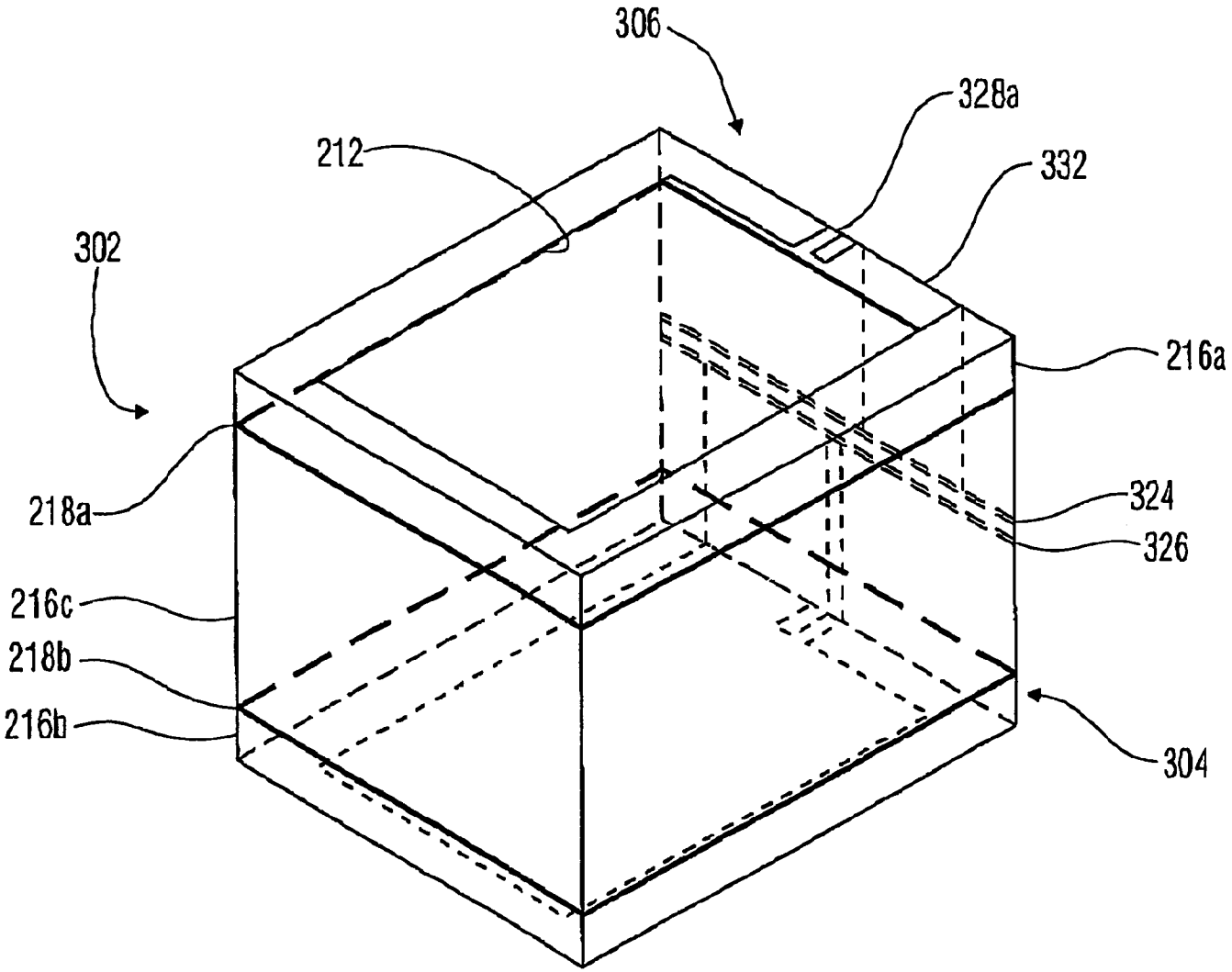
FIG. 4 is another side view of the antenna shown in FIG. 3.

FIG. 4 shows another side view of the embodiment, shown in FIG. 3, of the inventive antenna based on two PIFA antennas. The elements of the antenna shown in FIG. 4 are described by the same reference numerals as in FIG. 3. A repeated description of these elements will be omitted.

First prototypes of an antenna according to the embodiment shown in FIG. 4 were simulated by an FDTD simulator (FDTD=finite difference time domain) in order to set them up on a sensor module. The planar antennas 302, 304 corresponding to the dipole arms of a dipole antenna, here are PIFA antennas, each of the PIFA antennas 302, 304 being formed on one side of the sender to generate a radiation diagram which is isotropic to the greatest extent possible. According to the embodiment shown in FIG. 4, the sender module may be integrated in the third substrate layer 216*c*.

A balun was used for the measurement of the prototype of the antenna shown in FIG. 4, since all the measuring devices available operate using single-ended lines. This is why the adjustment of the antenna measured is not only the adjustment of the antenna, but also that of both elements.

Figure 5B:
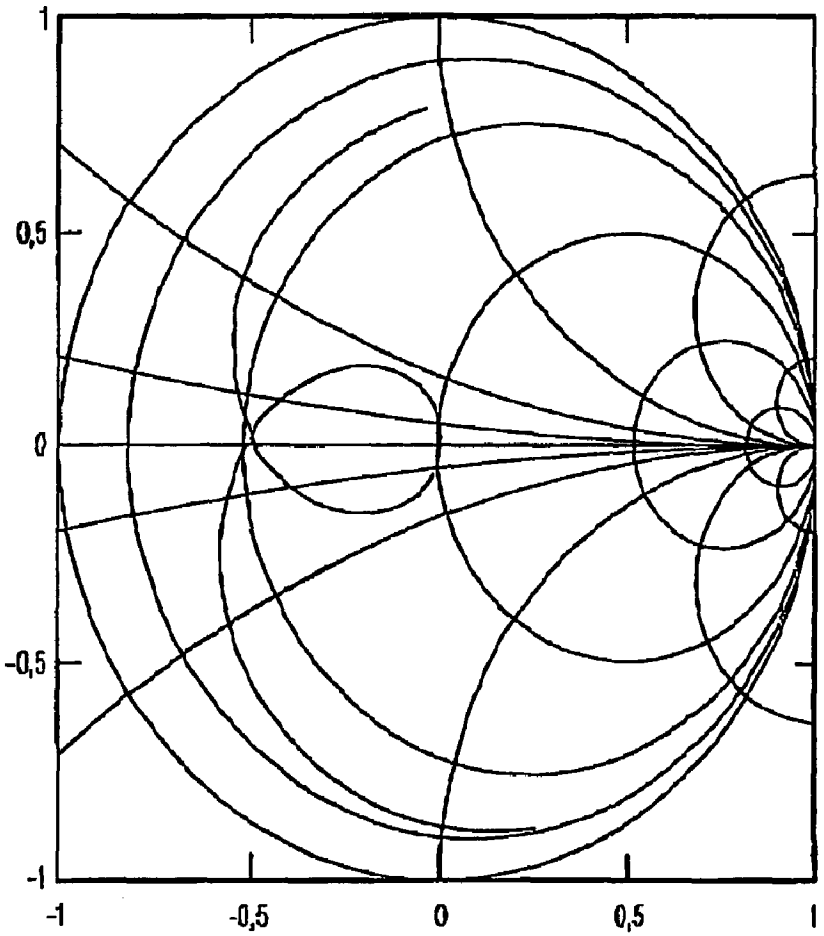
FIG. 5B shows a reflection factor diagram of the antenna shown in FIG. 4.
Figure 5A:
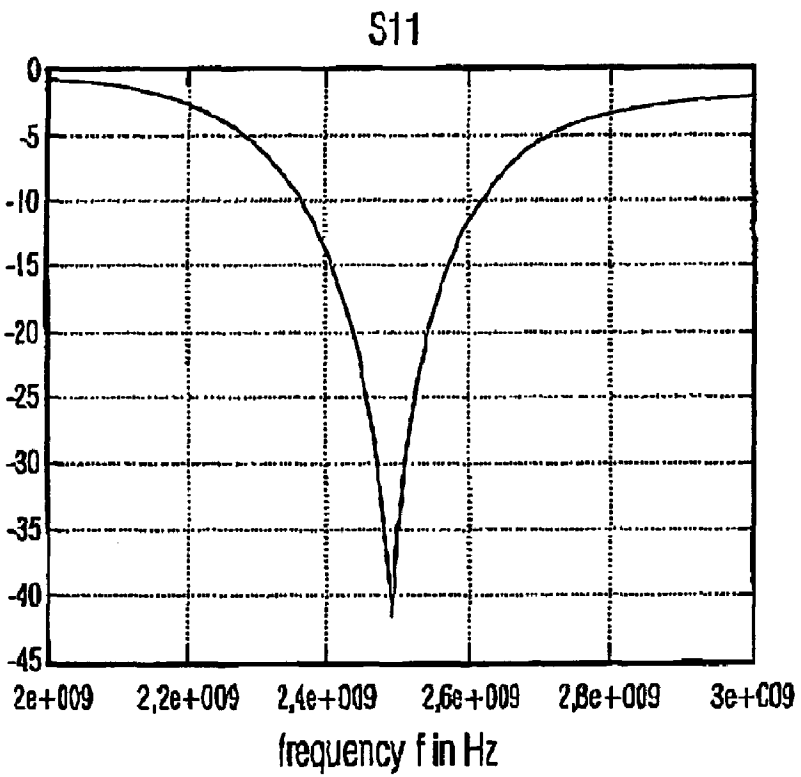
FIG. 5A shows a characteristic curve of the reflection factor of the antenna shown in FIG. 4.

A simulation of the antenna shown in FIG. 4 is shown in FIGS. 5A and 5B.

FIG. 5A shows a characteristic curve of the reflection factor S11 of the antenna shown in FIG. 4. The frequency in Hz is shown on the horizontal axis, the attenuation in dB is shown in the vertical direction. It can be seen from the characteristic curve shown in FIG. 5A that the resonance frequency of the antenna is about 2.5 GHz. The maximum reflection attenuation is approximately −42 dB.

FIG. 5B shows a reflection factor diagram of the antenna shown in FIG. 4. The locus of the reflection factor S11 can be seen from the reflection factor diagram.

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

What is claimed is:

1. An antenna comprising:

a substrate stack having a first substrate layer, a second substrate layer and a third substrate layer arranged between the first and second substrate layers;

a first planar antenna, with a first electronically conductive layer arranged between the first substrate layer and the third substrate layer, and a first radiation element on a surface of the first substrate layer opposite the first electrically conductive layer;

a second planar antenna, with a second electrically conductive layer arranged between the second substrate layer and the third substrate layer, and a second radiation element on a surface of the second substrate layer opposite the second electrically conductive layer;

a differential signal connection for providing a differential signal; and a coupler for coupling the first planar antenna to a first component of the differential signal and for coupling the second planar antenna to a second component of the differential signal.

2. The antenna according to claim 1, wherein the first planar antenna and the second planar antenna each comprise at least one planar radiation element.

3. The antenna according to claim 1, wherein the antenna is a dipole antenna and the first planar antenna is a first dipole half and the second planar antenna is a second dipole half of the dipole antenna.

4. The antenna according to claim 1, wherein the differential signal connection comprises a first region for providing the first component of the differential signal and a second region for providing the second component of the differential signal, the coupler for coupling being formed to couple the first planar antenna to the first region and the second planar antenna to the second region.

5. The antenna according to claim 1, wherein the coupler for coupling comprises a first electrically conductive connection for connecting the radiation element of the first planar antenna to the first region of the differential signal connection and a second electrically conductive connection for connecting the radiation element of the second planar antenna to the second region of the differential signal connection.

6. The antenna according to claim 1, wherein the coupler for coupling comprises a first radiation coupling element electrically insulated from the radiation element of the first planar antenna for coupling the first planar antenna to the first region of the differential signal connection, and a second radiation coupling element electrically insulated from the radiation element of the second planar antenna for coupling the second planar antenna to the second region of the differential signal connection.

7. The antenna according to claim 1, further comprising:

a first line for routing the first component of the differential signal and a second line for routing the second component of the differential signal;

wherein the first line and the second line are arranged in the second substrate layer;

a first short-circuit plate conductively connected to the first radiation element;

a second short-circuit plate connected to the second radiation element in an electrically conductive way;

a first feed line for connecting the first radiation element to the first line in an electrically conductive way; and a second feed line for connecting the second radiation element to the second line in an electrically conductive way.

8. The antenna according to claim 1, wherein the antenna may be integrated in a planar way.

9. The antenna according to claim 1, wherein the antenna comprises an omnidirectional characteristic.

* * * * *